US008628831B2

(12) United States Patent
Tang et al.

(10) Patent No.: US 8,628,831 B2
(45) Date of Patent: Jan. 14, 2014

(54) PREPARATION OF A POLYMER ARTICLE FOR SELECTIVE METALLIZATION

(75) Inventors: Peter Torben Tang, Søborg (DK); Jakob Skov Nielsen, Herlev (DK); Peter Caroe Nielsen, Søborg (DK); Hans Nørgaard Hansen, Birkerød (DK); Yang Zhang, Kgs. Lyngby (DK)

(73) Assignees: Danmarks Tekniskie Universitet, Lyngby (DK); IPU, Kgs. Lyngby (DK)

( * ) Notice: Subject to any disclaimer, the term of this patent is extended or adjusted under 35 U.S.C. 154(b) by 7314 days.

(21) Appl. No.: 12/593,880

(22) PCT Filed: Mar. 28, 2008

(86) PCT No.: PCT/DK2008/050078
§ 371 (c)(1),
(2), (4) Date: Jan. 21, 2010

(87) PCT Pub. No.: WO2008/119359
PCT Pub. Date: Oct. 9, 2008

(65) Prior Publication Data

US 2010/0151146 A1 Jun. 17, 2010

(30) Foreign Application Priority Data

Mar. 30, 2007 (EP) ..... 07006680

(51) Int. Cl.
*B05D 3/06* (2006.01)
*B05D 3/10* (2006.01)

(52) U.S. Cl.
USPC ..... 427/555; 427/557; 427/301; 427/306; 438/676

(58) Field of Classification Search
None
See application file for complete search history.

(56) References Cited

U.S. PATENT DOCUMENTS 3,262,122 A * 7/1966 Fleisher et al. ..... 430/322
4,239,789 A 12/1980 Blum et al.

(Continued)

FOREIGN PATENT DOCUMENTS

EP 0 151 413 A2 8/1985
EP 1 445 347 A1 8/2004

(Continued)

OTHER PUBLICATIONS

Zhang et al., "Selective metallization of polymers using laser induced surface activation (LISA)—characterization and optimization of porous surface topography", Int J Adv Manuf Technol (2011) 55:573-580.

(Continued)

*Primary Examiner* — Marianne L Padgett
(74) *Attorney, Agent, or Firm* — Foley & Lardner LLP

(57) ABSTRACT

The present invention relates to the field of selective metallization, and in particular to preparing a polymer article for selective metallization by submerging the article in a first liquid, and while submerged irradiate the article by a laser beam the area of the article on which the metal is to be deposited. An activation step, prior to the selective metallization, comprises submerging the article in an activation liquid for depositing seed particles in the selected area. The irradiation of the selected area is proportionate so as to cause a temporary melting of the polymer in the surface of the selected area of the polymer article. The invention is advantageous in that the preparation may be performed with a relatively high scan rate across the polymer article, and in that a quite limited use of toxic chemicals.

25 Claims, 8 Drawing Sheets

(56) References Cited

U.S. PATENT DOCUMENTS

| | | | | | |
|---|---|---|---|---|---|
| 4,440,801 | A | * | 4/1984 | Aviram et al. | 427/558 |
| 4,486,463 | A | * | 12/1984 | Rubner et al. | 427/555 |
| 4,615,907 | A | * | 10/1986 | Boeke et al. | 427/555 |
| 4,639,378 | A | * | 1/1987 | Inoue | 427/553 |
| 4,659,587 | A | | 4/1987 | Imura et al. | |
| 4,681,774 | A | * | 7/1987 | Halliwell et al. | 427/555 |
| 4,981,715 | A | | 1/1991 | Hirsch et al. | |
| 5,013,399 | A | | 5/1991 | Uesugi et al. | |
| 5,057,184 | A | * | 10/1991 | Gupta et al. | 216/65 |
| 5,084,299 | A | | 1/1992 | Hirsch et al. | |
| 5,169,678 | A | * | 12/1992 | Cole et al. | 427/555 |
| 5,260,108 | A | | 11/1993 | Braren et al. | |
| 5,405,656 | A | * | 4/1995 | Ishikawa et al. | 427/500 |
| 5,529,813 | A | * | 6/1996 | Kobsa et al. | 427/517 |
| 5,580,615 | A | * | 12/1996 | Itoh et al. | 438/676 |
| 6,013,336 | A | * | 1/2000 | Baumgart et al. | 427/555 |
| 6,565,763 | B1 | * | 5/2003 | Asakawa et al. | 216/56 |
| 6,565,927 | B1 | * | 5/2003 | Drzal et al. | 427/487 |
| 7,438,950 | B2 | * | 10/2008 | Kano et al. | 427/304 |
| 2005/0266352 | A1 | * | 12/2005 | Kano et al. | 430/311 |

FOREIGN PATENT DOCUMENTS

| | | |
|---|---|---|
| JP | 63-186877 | 8/1988 |
| JP | 63-197692 | 8/1988 |
| JP | 06-235169 | 8/1994 |
| JP | 11-012747 | 1/1999 |
| JP | 2003-027250 | 1/2003 |

OTHER PUBLICATIONS

Japanese Application No. 2010-501372, Examination Report, mailed Feb. 19, 2013.

* cited by examiner

A

B

PREPARATION OF A POLYMER ARTICLE FOR SELECTIVE METALLIZATION

CROSS REFERENCE TO RELATED APPLICATIONS

This application claims the benefit and priority to and is a U.S. National Phase Application of PCT International Application Number PCT/DK2008/050078, filed on Mar. 28, 2008, designating the United States of America and published in the English language, which is an International Application of and claims the benefit of priority to European Patent Application No. EP 07006680.8, filed on Mar. 30, 2007. The disclosures of the above-referenced applications are hereby expressly incorporated by reference in their entireties.

FIELD OF THE INVENTION

The present invention relates to the field of selective metallization, and in particular to preparing a polymer article for subsequent selective metallization.

BACKGROUND OF THE INVENTION

Polymer materials possess several properties which make them desirable for a large number of applications within fields such as hearing aid components, health care products, consumer electronics, toys, mobile phones, automotive components, etc. In such products it may be desirable to combine electrical and mechanical functions in a single component, for example to make electrical circuits directly on the cover or base of a polymer-based product. Such circuits may be made by means of positional selective metallization of desired areas.

In one type of metallization process, certain laser compatible particles are added to the polymer material before it is moulded. After the moulding, a laser beam is directed to the areas to be metalized to selectively expose these particles (this process is usually referred to as Laser Direct Structuring or LDS). A following electroless, or chemical, metallization may subsequently be performed on the surface of the exposed particles. This process is however expensive, since the entire polymer product is to be filled with particles although only the surface is used. Moreover, special particles and polymers are needed.

In an alternative process the entire surface may be metalized, and then in later process steps the unwanted metal areas are removed, e.g. by laser ablation, photo lithography followed by etching, etc. This method usually involves toxic chemicals in the pre-treatment, such as chromic acid. The method moreover often leads to a substantial waste of metal since most of the metal layers are removed.

U.S. Pat. No. 4,239,789 discloses a method for high resolution maskless electroless plating of an object. Preferential plating results from exposing those regions where plating is sought to an energy beam such as a laser, while the object to be plated is submerged in an electroless plating solution. The localised heating of the solution will speed up the chemical reaction leading to an increase of the plating rate by a factor of $10^3$ to $10^4$. This enhancement is sufficient to make masking unnecessary. However, the plating bath will still provide a plating film on unneeded positions on the object resulting in a waste of chemicals due to this lack of selectivity. Furthermore will the adhesion between the object to be plated and the deposited metal be relatively poor.

U.S. Pat. No. 4,659,587 aims to solve this selectivity problem by using the insight that when the object is heavily irradiated with e.g. a laser, an activation phenomenon appears in the irradiated areas of the object. The activation phenomenon supersede the need for preliminary activation before the actual plating takes place, and thus is activation not included in any of the examples mentioned in U.S. Pat. No. 4,659,587. The applied energy densities in the various examples of this reference are in the range from about 285 J/mm$^2$ up to about 10,000 J/mm$^2$ in order to obtain satisfactory metallization as measured by adhesion tests and profiling of the surface; FIG. 2. Thus, the object, typically a polymer, will be subjected to a quite intense energy absorption resulting in an inevitable burning or decomposition of the polymer object. This is also explicitly referred to as a "damaged area". A further disadvantage is the fact that to deliver a sufficient laser energy, the laser scanning across the object is relatively low, i.e. in the order of 10-100 micrometer/second, which make industrial application of this method somewhat limited.

Hence, an improved method of selective metallization would be advantageous, and in particular a more cost-efficient, and/or less toxic method would be advantageous.

SUMMARY OF THE INVENTION

It may be seen as an object of the present invention to provide a method which enables selective metallization without premixing the polymer with specific particles, or removal of already deposited metal to form a metal pattern. It may be seen as a further object of the invention to provide a method which enables selective metallization without involving toxic chemicals in the treatment of the article to be metallized.

In general, in methods of the prior art the selected area is either predefined in a way so that metallization only occurs on the predefined area, or the selected area is post-defined after the metallization by removing metal from unwanted areas. It may be seen as a further object of the present invention to provide an alternative to the prior art, by providing an alternative method for preparing a polymer for subsequent metallization.

Thus, the above described objects and several other objects are intended to be obtained in a first aspect of the invention by providing a method for preparing a polymer article for subsequent selective metallization, the method comprising

- submerging the article in a first liquid;
- in the liquid, irradiate the submerged article by electromagnetic radiation by irradiating the area of the article on which the metal is to be deposited, thereby forming a selected area wherein the source of radiation is a laser source, and
- an activation step, prior to the selective metallization, the activation step comprises submerging the article in an activation liquid for depositing seed particles in the selected area, wherein the irradiation of the selected area is proportionate so as to cause a temporary melting of the polymer in the surface of the selected area of the polymer article.

The invention is particularly, but not exclusively, advantageous for providing a non-toxic, or at least less toxic, method of defining or forming a selected area on a polymer article, which does not require special additives to the polymer before forming the article. Moreover the method is applicable to polymer articles of normal polymer grades. Embodiments of the present invention thereby introduce a cost reduction and increased flexibility as compared to methods of the prior art. Additionally, the present invention provides a method of forming a selected area on a polymer article, which may lead to relatively high scanning velocities of laser source across the article as compared to the prior art methods, in particular U.S. Pat. No. 4,659,587. Thus, a relative increase in scanning velocity in the order of 10 to 100 is feasible with the present invention.

Embodiments of a selective metallization process of an article may include at least three primary steps, and a number of sub-steps. The three primary steps may be:

1. Modify the selected area on and/or below the surface
2. Activate the selected area
3. Deposition of metal on the activated area In one aspect, embodiments of the present invention are directed to the first of these steps, in that it provides a method of surface modification suitable for preparing a polymer article for selective activation and subsequent metallization.

It may be beneficial, that the irradiation of the selected area may be further proportionate so at to cause a significant roughening in at least a portion of the selected area in order to provide a good adhesion of the subsequent metallisation. In particular, the significantly roughened portion of the selected area may form a substantially continuous area thereby facilitating coherent metallisation. Under some conditions, the significant roughening may comprise voids or cavities with an entry dimension of the void being smaller than a corresponding maximum dimension of the void. Thus, the voids may have an undercut edge that provides high strength adhesion of the subsequent metallisation.

It may be advantageous that the irradiation of the selected area may be further proportionate so at to cause a significant increase in porosity of the selected area. Several measures for porosity is available, one measure may be the ratio (f_por) between void volume to total volume, though it is contemplated that the open porosities forms better anchoring sites for metallisation. The significant increase in porosity (f_por) may be at least 5%, preferably at least 10%, more preferably at least 15%, most preferably at least 20%. It may also be at least 25%, preferably at least 30%, more preferably at least 40%, most preferably at least 50%.

In one embodiment, the temporarily melted region in the surface of the selected area has a depth (D) to width (W) ratio of at least 5%, preferably at least 10%, most preferably at least 15%, in at least in some regions of the selected area. This ratio may also 20%, preferably at least 30%, most preferably at least 40% to provide better adhesive strength for the metallisation. However, for some kinds of polymers the porosity may start from at least 2%. It may be the case that the depth (D) of the temporary melted region after irradiation extends significantly above the original surface. Thus, the depth may have a height above the original surface (i.e. prior to irradiation) as it will be explained in more details in connection with FIG. 8 below.

Beneficially, the temporarily melted polymer in the selected area forms a substantially continuous area to obtain good adhesion of the metallisation and/or satisfactory conduction through the metallised track i.e. without gabs or holes.

Tests indicate that the averaged delivered irradiation energy to the selected area may beneficially be selected in dependency of the effective melting point, or melting interval, of the polymer article. Preferably, the averaged delivered irradiation energy is selected so as to avoid burning or decomposition of the polymer article. For some embodiment, the averaged delivered irradiation energy to the selected area may be maximum 5 J/mm$^2$, preferably maximum 10 J/mm$^2$, or most preferably maximum 20 J/mm$^2$. For other conditions, e.g. other polymers, the energy may be maximum 25 J/mm$^2$, preferably maximum 30 J/mm$^2$, or most preferably maximum 40 J/mm$^2$. The invention may also work optimally in the range 0.01-100 J/mm$^2$, preferably in the range 0.05-50 J/mm$^2$, or most preferably in the range 0.1-10 J/mm$^2$.

In subsequent process steps, an embodiment of the invention may further comprise metallization of the article. It is an advantage of the present invention, that the forming of the selected area may be performed in a separate step. Existing facilities for selective metallization may thereby relatively easy be adapted for carrying out embodiments of the present invention.

The metallization comprises the processes of activating the selected area, and deposition of metal on the activated area.

In the activation process the article is submerged in an activation liquid for depositing seed particles in the selected area. It is an advantage of the present invention that the seed particles only or at least substantially only adhere in the selected area. Any or at least most of the seed particles which may be deposited in a non-selected area, may be removed by a rinsing subsequent to the activation step. The rinsing may be performed by water. It is an advantage of the present invention that the seed particles adhere sufficiently strong in the selected area or surface modified area so that they are not removed by the rinsing, while seed particles, if deposited, does not adhere sufficiently strong in the non-selected area, so they may be removed by rinsing. It is an important aspect of the present invention that the inventors of the present invention have had the insight, that by immersing a polymer article in liquid while defining a selected area by irradiation, seed particles will in a subsequent activation adhere selectively in the irradiated area, thereby facilitating selective metallization.

The seed particles may be palladium particles or palladium complexes. The deposition of the palladium particles may be the outcome of a chemical precipitation reaction occurring in the activation liquid in the presence of the surface modified polymer article. In an embodiment, the activation liquid is in the form of a solution comprising palladium salt and tin salt, including such salts as palladium-chloride and tin-chloride. Other embodiments include, but are not limited to, such salts as palladium-sulphate and tin-sulphate.

To metalize the selected area, a deposition step may be performed subsequent to the activation step. In the deposition process, the article is submerged in a deposition liquid. In an embodiment, the deposition liquid may be a copper deposition liquid. Other embodiments include, but are not limited, to the deposition of nickel, cobalt, silver, tin, palladium and gold. The deposition may be performed in an electroless chemical plating process.

The polymer article is submerged in the first liquid while the selected area is defined. The first liquid may be selected from the group of water and inorganic acids or salts thereof, organic acids or salts thereof, inorganic bases or salts thereof, organic bases or salts thereof, and solutions or mixtures thereof. Moreover, it is contemplated that an organic solvent, such as ethanol or N-methyl-pyrrolidon, may be used as the first liquid. It is an advantage of the present invention, that the first liquid may be water since water is non-toxic and cheap. However, it is contemplated that for certain situations, other liquids may be used.

The acid may more specifically be selected from the group consisting of phosphoric acid, sulfuric acid, hydrochloric acid, methanesulfonic acid, citric acid, succinic acid, adipic acid, amidosulfuric acid, malonic acid, methanoic acid, ethanoic acid, propanoic acid, n-butanoic acid, n-pentanoic acid, n-hexanoic acid, oxalic acid, sodium hydrogen sulfate, potassium hydrogen sulfate, borofluoric acid, sodium hydroxide, potassium hydroxide, ethanol, iso-propanol, ethylenglycol, N-methyl-pyrrolidon, and mixtures thereof.

The temperature of the first liquid is typically held at room temperature, since this is most convenient as no special temperature control is required. In general may the temperature of the first liquid be in the range of 5° C. and 50° C.

The first liquid may be agitated during the irradiation of the polymer article. It may be advantageous to agitate the liquid in order to remove any bubbles that may be created from an interaction between the liquid and the laser, i.e. due to heat generated from the interaction. The bubbles may adhere to the surface of the article. Bubbles are not created in all situations, and it is not necessarily a problem for the process of defining the selected area, even if bubbles are created. Nevertheless there may be situations where the presence of bubbles is undesirable, since the bubbles scatter the radiation and moreover may cool the surface area of the article at the adhesion area. In order to remove the bubbles the liquid may be agitated, for example by providing a flow in the liquid.

The first liquid may also be agitated in order to avoid an overall heating of the liquid from the irradiation.

The irradiation of the polymer article may release particles from the surface. In order to remove these particles from the first liquid the first liquid may be filtered. The first liquid may also be agitated, in order to ensure a flow through the filter. The particles may be removed if they pose a problem due to scattering of radiation from the particles, or in order to clean the liquid to control any waste related aspects. At least in some situations, the first liquid may become turbid during the irradiation. At least in such situations, a filtering may be necessary.

Advantages of using a laser as the light source include that parameters such as beam intensity, spot size and wavelength may be selected and controlled in accordance with a specific situation of use, such as adapted to a choice of first liquid or the material of the polymer article, or other aspects. Moreover a laser beam may controllably be irradiated onto a small area, thereby facilitating a high resolution of the pattern or shape of the selected area, as well as facilitating selective deposition of small structures. In general, any laser source capable of delivering sufficient intensity at a desired wave length may be applied. The laser source may be a near infra red laser source capable of emitting radiation at wavelengths in the range of 800 nm to 1100 nm, such as a Nd:YAG laser, a fibre laser or a diode laser. Laser sources in the near infra red range may be provided which is capable of providing a sufficient intensity of the emitted beam. It is contemplated that high-intensity lasers in the far infra red or visible range may also be applied, however such laser are typically not capable of delivering a sufficiently intense beam. A $CO_2$ laser may pose problems relating to absorption from the first liquid, especially if the first liquid is, or contain, water.

The laser source may be selected in order to optimize the power deposition at the surface of polymer article. Thus, the laser source may be selected in accordance with the absorptive properties of the polymer article. Alternatively, or in addition to, the polymer material may be mixed with a dye.

It is an advantage of the present invention that the selected area defined by applying a laser as the source of irradiation may span a three-dimensional (3D) area of the article. The polymer article may thereby be formed into its final shape, enabling preparation of and selective metallization on, the final shape of the polymer article.

In an embodiment, at least part of the selected area is defined by moving the irradiating light source. In another embodiment, the article may prior to irradiating the article, be covered by a mask, the mask defining at least part of the selected area.

The laser may be a pulsed laser or a continuous wave (cw) laser. To ensure sufficient intensity in the beam a pulsed laser may be used.

In general, the skilled person may match the radiation source and the polymer article by adjusting such parameters as the intensity of the source, the wavelength of the source, the focus area, the absorptive properties of the polymer article, the absorptive properties of the first liquid, etc. It is however to be understood, that the invention is not limited to any specific settings of the above or other parameters, as long as the energy is sufficient to create a thermal change in the polymer substrate without leading to decomposition, vaporisation, ablation or burning.

The polymer may be of a thermoplastic material. The polymer is selected from the group of Acrylonitrile Butadiene Styrene (ABS), PolyButylene Terephthalate (PBT), Liquid Crystal Polymer (LCP), CycloOlefin Copolymer (COC), PolyMethyl MethAcrylate (PMMA), PolyPropylene (PP), PolyEthylene (PE), PolyTetraFluoroEthylene (PTFE), PolyPhenylene Ether (PPE), PolyStyrene (PS), PolyCarbonate (PC), PolyEtherImide (PEI), PolyEtherEtherKetones (PEEK), Polyethylene Terephtalate (PET), PolyAmide (PA) and blends thereof.

The polymer article may be prepared for selective metallization directly after it has been formed. However, there may be situations where it would be advantageous to rinse the article prior to submerging the article in the first liquid. The rinsing may be performed by a suitable solvent, such as ethanol and/or water.

The article may also be subjected to a drying process prior to submerging the article in the first liquid. The drying may be performed by heating the article for a given period of time, for example in an oven held at a temperature in the range of 50° C. to 90° C. for 1 to 24 hours.

After the metallization has been finalized, a protection layer on top of at least part of the metalized area may be deposited. The protection layer may be a polymer layer. The protection layer may be provided on articles where parts of or the entire metalized selected area should not be exposed during use.

BRIEF DESCRIPTION OF THE FIGURES

Embodiments of the invention will be described, by way of example only, with reference to the drawings, in which.

DESCRIPTION OF EMBODIMENTS

An important field of use for the present invention is the field of moulded interconnect devices (MID). In such a device, the functionality of a polymer part can be increased by adding electrical interconnections as well as simple electronics onto a traditional polymer article. However, the invention could also contribute to other fields such as micro fluidics (electrodes for electrochemical sensors), security (marking of polymer products) and RF-tags (identification tags based on small microchips powered by an inductive coil).

Figure 1:
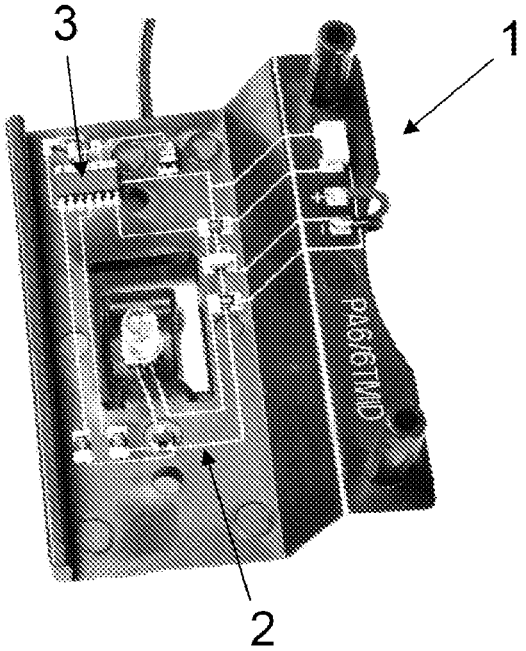
FIG. 1 is an example of a polymer article which is provided with electrical interconnections and electronic components.

FIG. 1 is an example of a polymer article 1, here a PA6 (nylon) article. The article is a 3D polymer article, which is provided with electrical interconnections 2 and electronic components 3 such as an integrated circuit (IC). In such a device an electronic circuit need not be fabricated separately, e.g. on a printed circuit board (PCB), and fitted onto the polymer article in a mounting process. The polymer article 1 is provided as an illustration of the field of applicability of the present invention. The article is not fabricated by a method in accordance with the present invention, but by laser direct structuring (LDS). A similar polymer article may nevertheless be prepared by application of the present invention. An advantage of the present invention includes that no premixing of the polymer material would be required.

Figure 2:
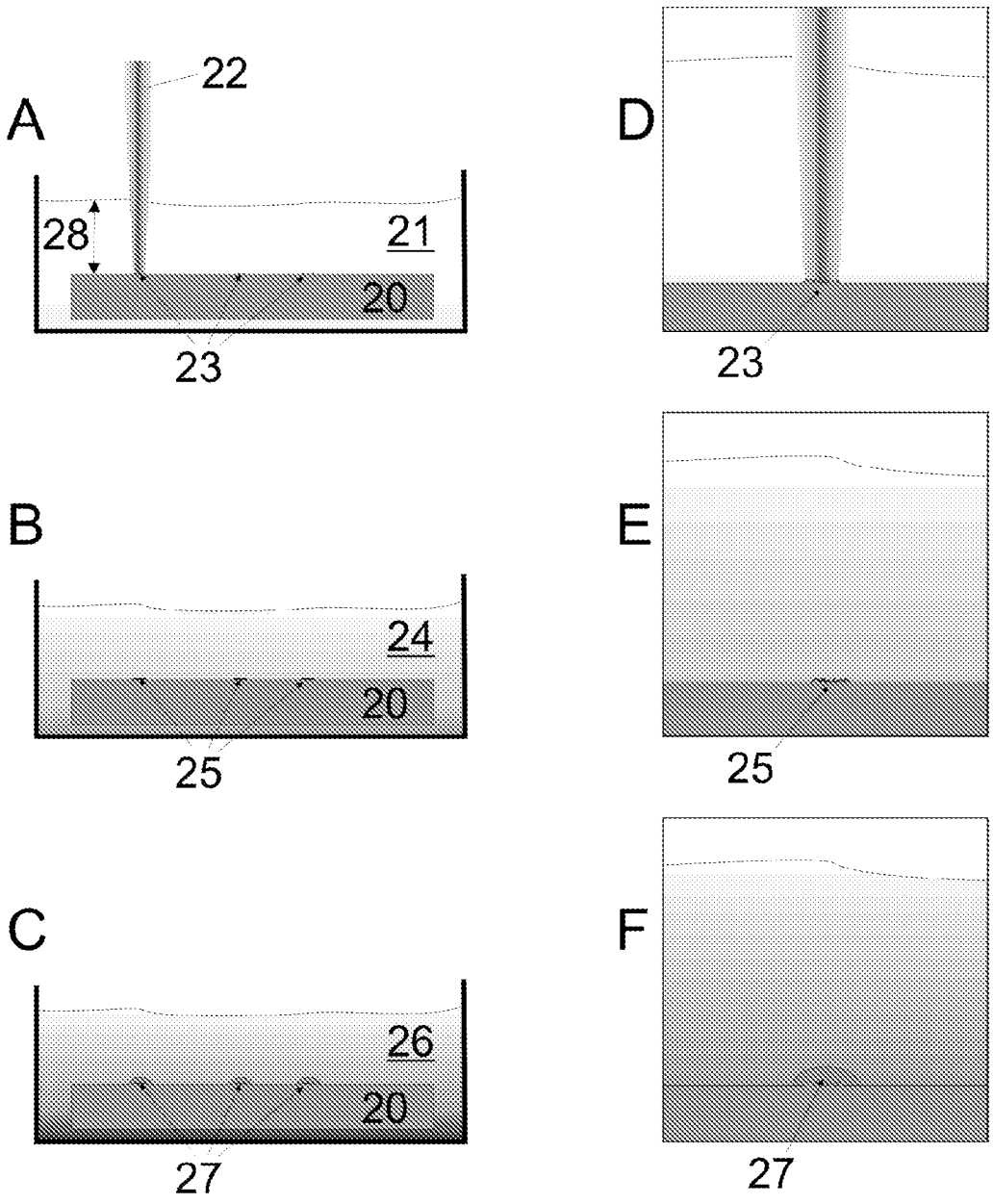
FIG. 2 illustrates embodiments of process steps of a selective metallization in accordance with the present invention.

FIG. 2 illustrates embodiments of process steps of a selective metallization in accordance with the present invention.

FIG. 2A and 2D (2D is a close-up of a portion of 2A) illustrates an embodiment in accordance with an aspect of the invention, being the preparation of the polymer article for subsequent selective metallization. FIG. 2B illustrates a subsequent activation process and FIG. 2C illustrates a subsequent metal deposition process.

In FIG. 2A the polymer article 20 is submerged in the first liquid 21. While submerged, the article is irradiated by a laser beam 22 in the area 23 of the article on which the metal is to be deposited, thereby forming a selected area. The surface is thereby selectively modified, and a small roughness and/or porosity may be formed by the rapid melting and solidification inflicted by the thermal energy combined with the surrounding first liquid. The irradiation beam 22 may be controlled by an optical setup including movable mirrors (not shown).

Typically the first liquid covers the article by a few millimeters up to a few centimeters, this is illustrated by the arrow denoted 28.

In an embodiment, the selected area is defined in de-ionized water by means of a pulsed Nd:YAG laser at 1064 nm.

Subsequent to defining the selected area, the article is removed from the first liquid and rinsed. The rinsing process typically consists of dipping the article in a sequence of water baths.

After this step, the article may be stored for a given period of time. Tests have shown that the article may be kept in the ambient for at least a week.

In FIGS. 2B and 2E the polymer article 20 is submerged in the activation liquid 24 for depositing seed particles 25 in the selected area.

In an embodiment, palladium seed particles are deposited in accordance with the chemical reaction:

$$Sn^{2+}+Pd^{2+}+\text{modified surface}\rightarrow Sn^{4+}+Pd^{0}$$

where the neutralized palladium is deposited onto the modified surface.

In an embodiment, the activation liquid may be provided by mixing tin-chloride with palladium chloride. As an example, the activation liquid may comprise 0.77 g/L $PdCl_2$+9 g/L $SnCl_2$+35.2 g/L concentrated HCl+190 g/L NaCl. The activation being conducted at room temperature, with the article submerged for 5 minutes. Experiments with slightly adjusted concentrations, submerging period and temperature have also been conducted with a successful result.

It is contemplated that a two-step activation may be performed, where first a sensitizing step is conducted in 50 g/L $SnCl_2$+140 mL/L concentrated HCl at RT for 2 min., followed by a submersion in 0.5 g/L $PdCl_2$+5 g/L sodium acetate (pH=4.4, adjusted by HCl) at 43° C. for 30 sec.

Subsequent to the activation, the article is removed from the activation liquid and rinsed. The rinsing process typically consists of dipping the article in a sequence of water baths. In the activation liquid, palladium particles may also be deposited onto impurities and cracks or other irregularities. These particles are removed, at least to a large extend, in the rinsing process.

In FIGS. 2C and 2F the polymer article 20 is submerged in a deposition liquid 26 for depositing metal 27 in the selected activated area.

In an embodiment, the deposition liquid is a copper deposition liquid. Copper deposition may be performed in a commercially available electroless chemical copper plating bath. Such baths are available under the trademark Circuposit. In an embodiment, the metal has been deposited in a commercial available copper bath from the company Shipley (Circuposit 3350) for a few minutes up to 1 hour at 45° C.

In another embodiment, the deposition is provided by submerging the article in 40 g/L ethylenediaminetetraacetic acid (EDTA)+4.2 g/L $CuCl_2$+3.0 g/L concentrated formaldehyde+10 mg/L NaCN (pH adjusted to 12.2 by NaOH) at 60° C. for a few minutes. The deposition liquid may be agitated by stirring or by passing air bubbles through the liquid.

In yet another embodiment, nickel have been deposited onto the selected area by submerging the article in 10.5 g $NiSO_4$+10.6 $Na_2H_2PO_2$+17.1 mL conc. acetic acid diluted in 400 mL water and adjusted to a pH of 4.5 by $NH_4OH$ at 90° C.

Figure 3:
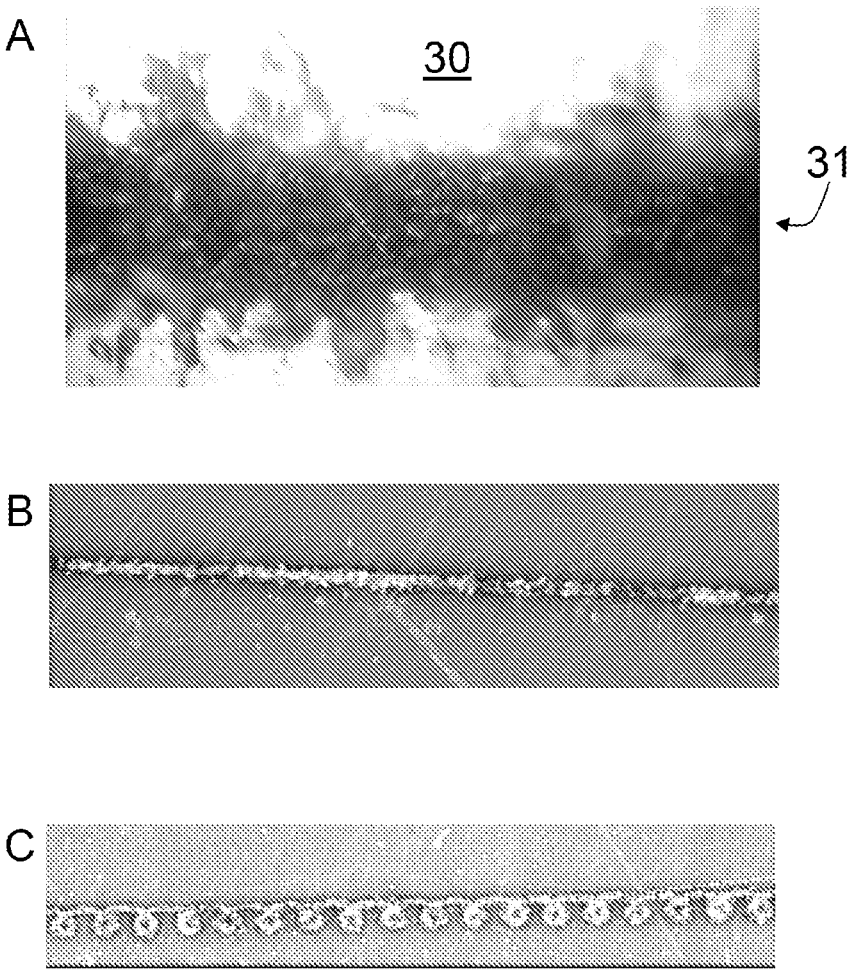
FIG. 3 show photographs of an ABS plate, the photographs being obtained at different process stages.

FIG. 3 show photographs of an ABS plate, the photographs being obtained at different process stages.

FIG. 3A illustrates a photography of an ABS plate 30 with a close-up of a selected area 31 in the form of a track. The selected area is defined in de-ionized water by means of a pulsed Nd:YAG laser where the position of the laser spot is movably controlled by a movable mirror for directing the beam from the laser to the surface of the plate. The size of the laser spot is approximately 100 μm. The width of the track 31 is comparable to the size of the spot, and the length of track is a few centimeters. The illustrated track is not perfectly well defined, however it is possible to create tracks which have a more well defined and straight edge.

The laser beam may be moved so that a continuous track is provided, thus depending on the repetition rate of the pulsed laser, the speed of the laser spot, may be so low that the spot of two successive pulses at least substantially overlap. However if the track is moved faster, so that two successive pulses do not overlap, a continuous metal track may nevertheless be provided, but the metallization process typically takes longer time, since the metallization need to "grow" out from the spots and combine.

In general, repetition factors between 1000 and 2600 Hz have been used and speeds of the laser spot across the surface of the article ranging from 1 to 500 mm/s have been applied. The pulsed Nd:YAG laser have been operated at an output power of a few watts, typically an average power of 3.4 W. However, the specific parameters depend on the situation of use.

Experiments performed by the applicant indicate that a quite essential parameter of the irradiation process is the averaged delivery energy per area, E_A, of the polymer article. Thus, for a laser with an average power W, a spot dimension L, the laser having a scan velocity V across the polymer article, the following relation holds;

$$E_A=P/(L*V).$$

Needless to say, various combinations of lasers and working parameters may give (substantially) the same averaged delivery energy per area. It may be mentioned that the applicant has found that the present invention enables particularly high scanning velocities across the polymer article to be metallised. This is a highly important aspect for manufacturing conditions.

FIGS. 3B and 3C show examples of photographs of metalized laser tracks on ABS plates. The tracks have been metalized subsequent to the irradiation while submerged in water.

FIG. 3B shows a track of copper in the form of a straight line, whereas FIG. 3C shows a track provided with wobbles along the extension of the track. The width of the track is determined by the size of the spot, and the width of the track is in FIG. 3C approximately 100 μm. In order to ensure a sufficient intensity of the laser spot, it may be necessary to focus the laser spot to a small size. With small laser spots it may therefore be time consuming to provide wide tracks. If wide tracks are desirable, one way of providing wide tracks in a fast way is to make wobbles. Here the wobbles are separated. However by adjusting the spacing between the wobbles, and possible providing an overlap between successive wobbles, and the deposition parameters, a continuously wide track may be provided. In a situation where the intensity in the spot of a certain size is insufficient, wider tracks may also be provided by providing, i.e. focusing, the spot in the form of a line. Wobbles and line spots may also be used for providing larger areas to be metalized.

In an embodiment, wide tracks and filled areas may be provided by combining a line spot with a mask. In this way the track width may be defined by the mask, without specific requirements to the line width of the spot, in particular a line spot which is larger than the desired track width may be applied.

The selective metallization have been conducted in accordance with process steps as disclosed in connection with FIG. 2. FIG. 3A is provided in accordance with embodiments as disclosed in connection with FIG. 2A, in that the ABS plate was immersed in water while irradiated. The ABS plates of FIGS. 3B and 3C have subsequently been immersed in baths comprising a mixture of palladium chloride and tin-chloride in accordance with embodiments disclosed in connection with FIG. 2B. The copper was deposited in a commercial electroless plating bath from Shipley, as disclosed in connection with FIG. 3C.

Experiments have shown that the method is even applicable for articles with stepped surfaces, as least for surfaces having steps in the order of 4 to 5 mm or less. Experiments have also shown that articles made of more than one type of polymer (for example PC and ABS) can be selectively metalized using identical laser parameters as well as subsequent steps for selective activation and metallization.

Moreover, it may be possible provide through holes as a part of a process of the present invention. Through holes may be provided by burning holes in the polymer article which are metalized in subsequent steps. If through holes are needed, drilling or other special handling may be avoided.

Figure 8:
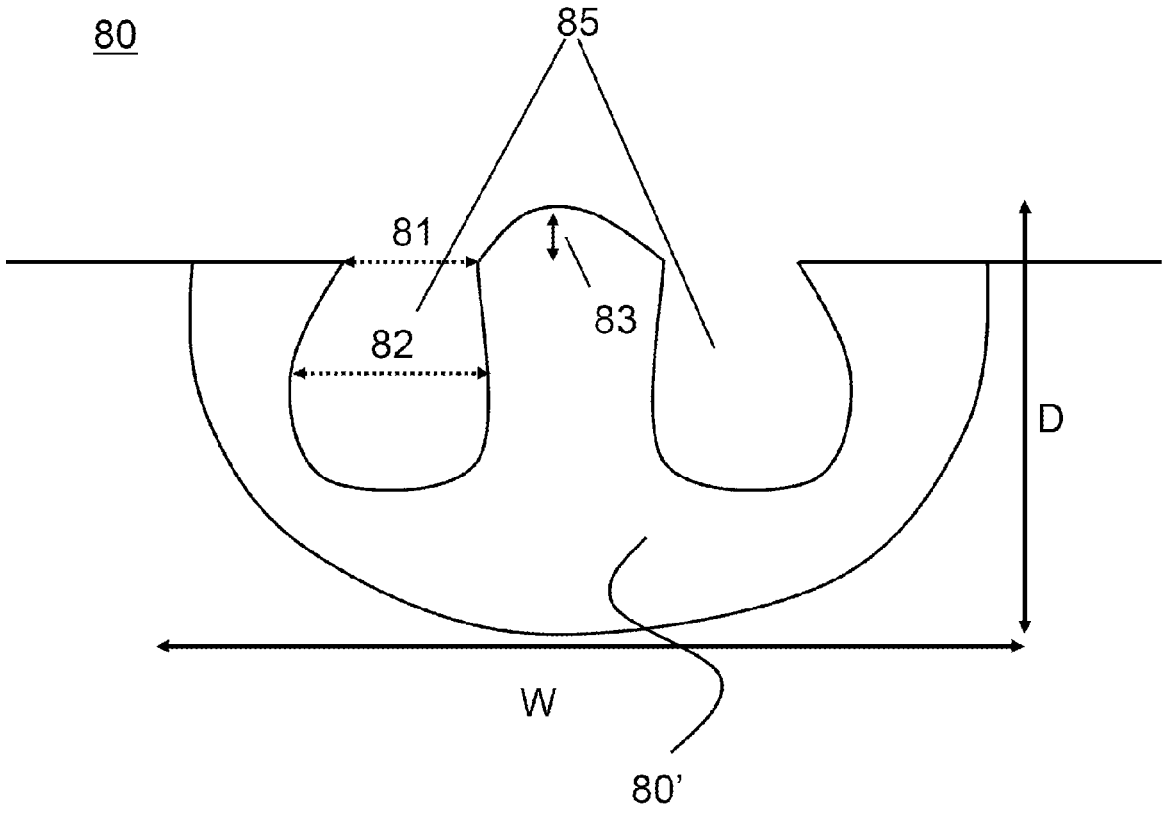
FIG. 8 is a schematic cross-sectional drawing showing voids created after preparation for metallization according to the present invention.

FIG. 8 is a schematic cross-sectional drawing showing voids 85 created in the re-melted regions 80' of polymer article 80 after preparation for metallization. Extensive microscopy studies of samples have revealed that often, but not always, complete and adherent metallisation is related to voids 85 or bulky cavities extending down from the surface of the polymer article. These voids 85 have an entry dimension 81, e.g. length or area, which is lower than a corresponding maximum dimension 82 within the void. The re-melted region 80' can be characterised by a width W and a depth D, where it is also observed that the depth D may increase with a certain height 83 above the surface level of the polymer article before irradiation. The width W and the depth D of the re-melted region 80' may change along the length direction of the selected area depending in particular on the irradiation process applied. Thus, for a pulsed laser the re-melted region 80' may have the largest dimensions where the laser energy applied was at a maximum, and similarly there may be parts of the selected area where the irradiation was insufficient to cause metallisation. In the latter case, metallisation may nevertheless take place because the metallisation may bridge across these regions where insufficient or no irradiation has hit.

Without being bound to any specific theory, it is contemplated that mechanical anchoring of the metal portions within the voids 85 has a significant part for explaining the advantageous results obtained by the present invention. Thus, during metallisation the voids 85 are more or less filled with metal and because of the high cohesive strength of the formed metal, the adhesion of the metal layer to the polymer article is comparable to, or similarly to, the cohesive strength of the polymer article itself.

It should be mentioned that the applicant have also performed extensive tests to clarify whether chemical modification and/or changes of the polymer article are induced by the laser irradiation according to the present invention, but so far little or no chemical change has been observed in the surface of the polymer article as a result of the laser irradiation for preparing to subsequent metallisation.

Examples

Figure 7:
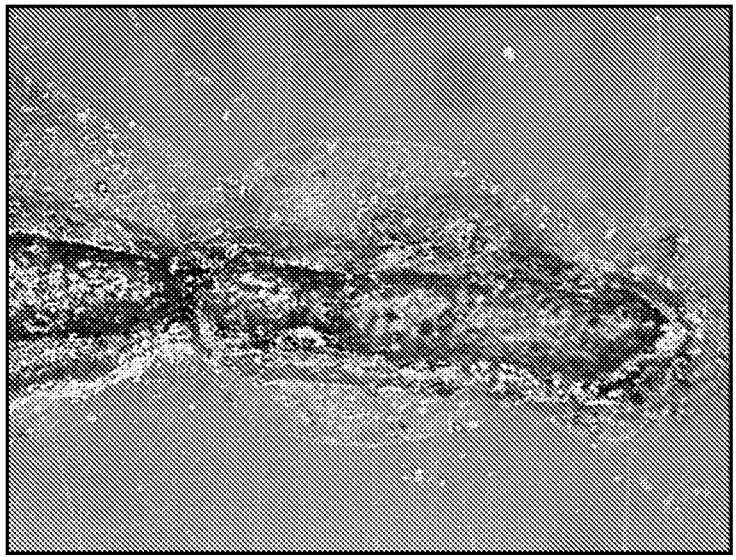
FIG. 7 show microscopy images of metalized tracks using two different scan velocities of the laser source.
Figure 7:
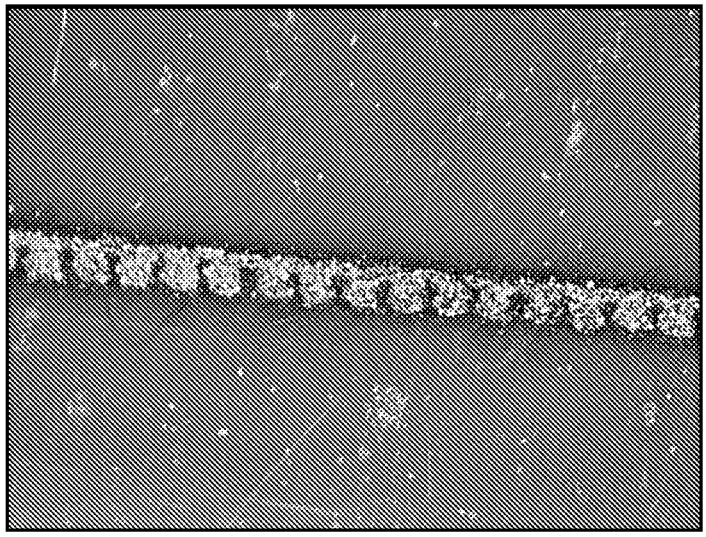

1. A Nd:YAG laser (1064 nm) is used to draw a pattern on the surface of flat piece of ABS polymer. The ABS sheet is dyed green and produced by extrusion. During the laser treatment the ABS piece is placed in a flat glass container and covered by 1-2 cm of distilled water. The laser treatment is performed in Q-switching mode at 1200 Hz with an average power of 3.4 W. This results in a focused laser spot on the surface of the sample of approximately 80 μm in diameter. Tracks are drawn in a wobble pattern (0.4 mm wide, see also FIG. 7*b*) at a scan-rate of 60 mm/s and with a repetition factor of 30 (each line is redrawn 30 times).

After rinsing and drying of the sample it is stored for 1-2 days.

The laser induced selectively modified tracks are then activated by simple dipping of the sample in an activation solution. Prior to the activation the samples are cleaned with ethanol and water (in that order). The activation solution contains 0.77 g/L $PdCl_2$+9 g/L $SnCl_2$+35.2 g/L concentrated HCl+190 g/L NaCl. The activation is being conducted at room temperature, with the article submerged for 5 minutes.

After activation the samples are rinsed carefully in plenty of distilled water, and placed in a electroless copper deposition bath supplied by Shipley (Circuposit 3350) at 45° C. for one hour. After deposition tracks up to 10 cm in length has a resistance below 0.2 Ohm.

Figure 4:
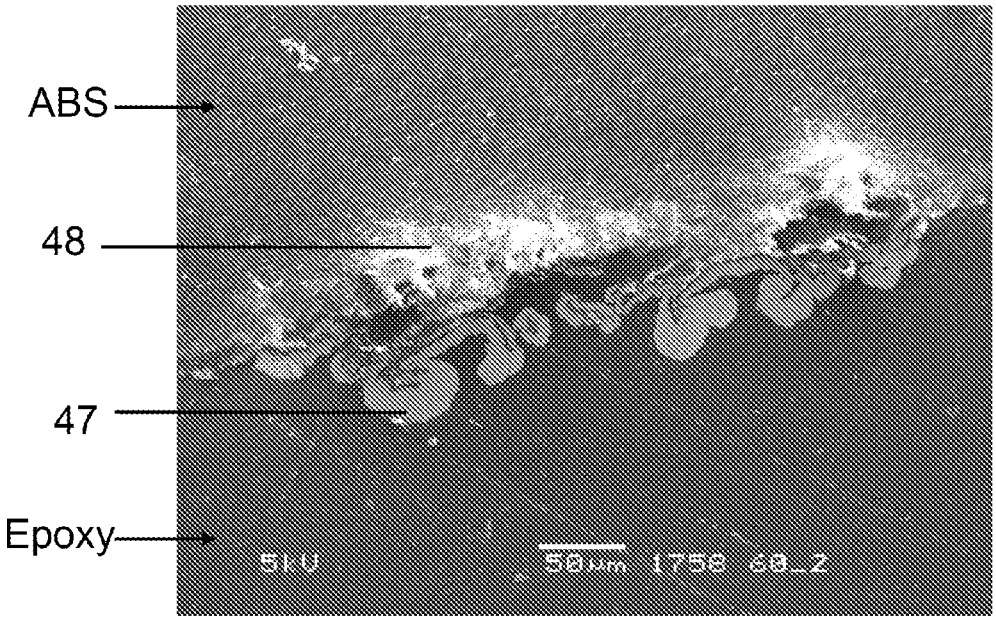
FIG. 4 shows a cross-sectional scanning electron microscopy image of an ABS article metalized using the present invention.

The tracks are 0.4 mm in width (corresponding to the wobble size) and has excellent adhesion to the substrate (evaluated using a simple tape-test). A cross-section of the metalized samples can be seen in FIG. 4. It is believed that the white area 48 is an artefact in the SEM imaging. The metal voids 47 underneath the surface are seen to be rather bulky.

Figure 5:
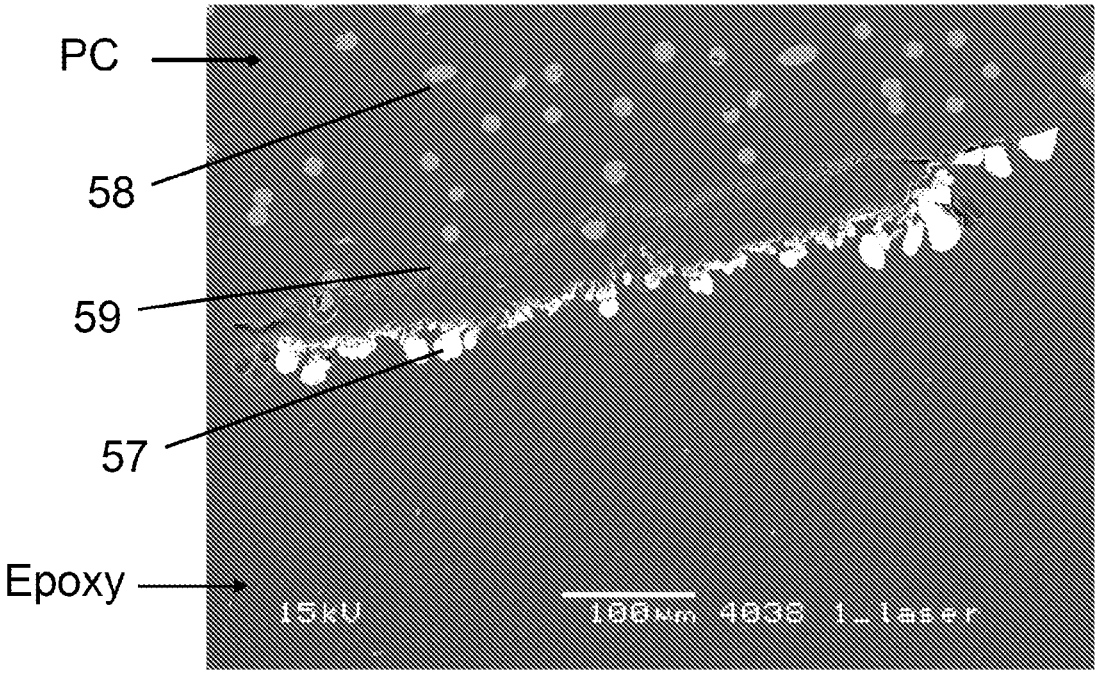
FIG. 5 is another SEM image showing a polycarbonate (PC) article metalized using the present invention.

2. Laser treatment similar to example 1, but using injection moulded samples of PC (with 10% glass fibres as filler) and PEEK with 30% GF. A cross-section of a metalized PC sample can be seen in FIG. 5. The metal portions 57 are seen to be rather bulky or voluminous extending down from the surface of the polymer article. It is assumed that the boundary between the re-melted region and the not temporarily melted region can be seen as indicated by number 59. Glass fibres 58 are also visible in the cross-section.

3. Laser treatment similar to example 1 and with reduced laser power. The samples were injection moulded black samples of polymer materials with increasing melting points (PE, ABS, PS and PC with 10% GF). The results are summarised in Table 1.

TABLE 1

| Laser power | Metallisation coverage (%) | | | |
|---|---|---|---|---|
| Average (W) | PE | ABS | PS | PC |
| 3.4 | 100 | 100 | 100 | 100 |
| 0.63 | 100 | 100 | 100 | 90 |
| 0.42 | 100 | 80 | 60 | 50 |
| 0.21 | 50 | 10 | 10 | 5 |

Metallisation coverage is determined visually by optical microscopy. Based on an assessment made by the observer, the coverage is set to a fraction of complete metallisation (100%).

It can be appreciated from Table 1, that there is an apparent inverse relationship between the necessary average irradiation energy per area required for preparing the polymer article for metallisation, and melting point of the polymer. Thus, for a low melting polymer like PE, 0.42 W suffices to obtain 100% metallisation, whereas for a higher melting polymer like PC, 3.4 W is needed to obtain complete metallisation. Presently, the applicant do not have sufficient experimental data to extract any analytical and/or empirical expressions with regard to the said inverse relationship, but it is contemplated that based on Table 1, it is within the reach and capabilities of the skilled person working with polymer metallization to obtain such a more elaborated analytical and/or empirical expression. The applicant is currently undertaking and planning to conduct more experiment in that respect.

Figure 6:
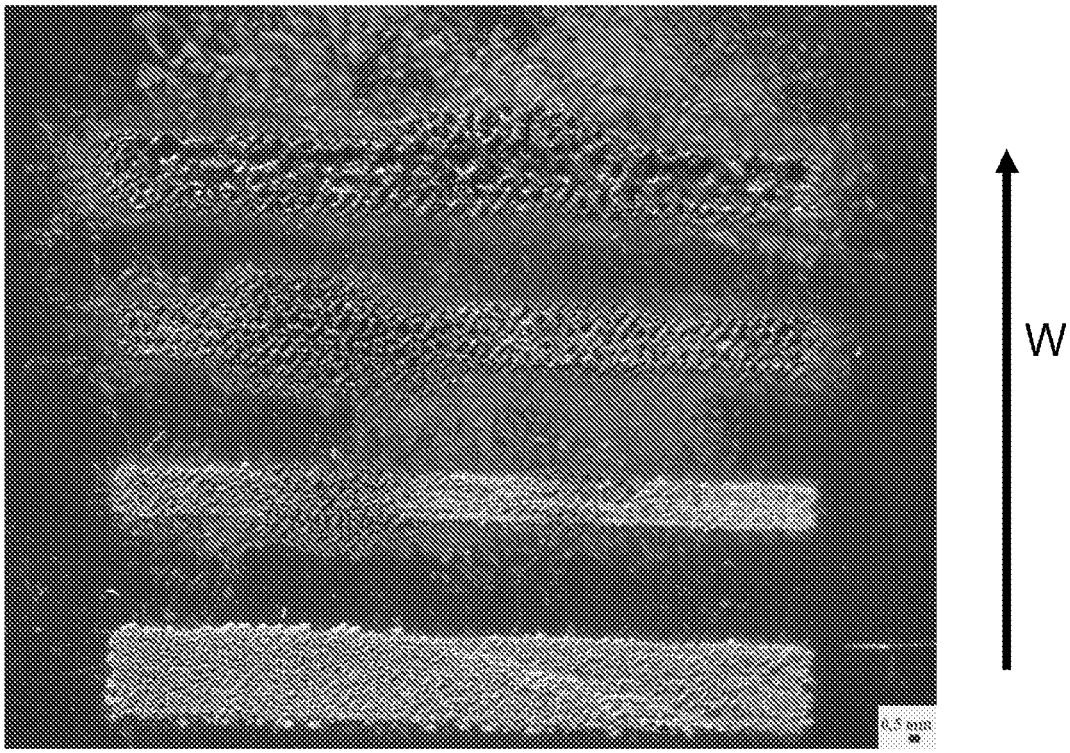
FIG. 6 is a plain view microscopy image showing four tracks prepared with different irradiation energies per area.

4. Laser treatment similar to example 1, but using Q-switching frequencies 1200, 2000, 3500 and 5000 Hz resulting in average laser power values of 3.4, 4.9, 7.1 and 8.9 W. The sample was black injection moulded PE. In FIG. 6 the result of the metallization of the four lines obtained with increasing Q-switching can be seen, with the lowest average power (3.4 W as used in Example 1) at the bottom and the highest (8.9 W) at the top. Thus, as indicated by the arrow on the right hand side the power W increased towards the top. Notice that the two uppermost tracks are effectively not metallised as no metallic reflection can be seen, whereas the two lowermost tracks have a metallic reflection indicating a successful metallization as also confirmed by resistive test along the track. The two uppermost tracks have accordingly received too much energy per area, the energy most likely exceeding the energy needed for temporary melting resulting in decomposition and/or burning of the polymer in the surface portions. Possible, too much melting may explain the unsuccessful metallisation.

5. Laser treatment similar to Example 1, but varying the scan rate from 1 mm/s to 60 mm/s see FIG. 7*a* (1 mm/s) and FIG. 7*b* (60 mm/s). Using the slow scan rate the sample is obviously decomposed and/or burned as a result of the increased average energy density, and consequently is the metallization incomplete.

The individual processes of the embodiments of the invention may be physically, functionally and logically implemented in process apparatuses in any suitable way such as in a single unit, in a plurality of units or as part of separate functional units.

Although the present invention has been described in connection with the specified embodiments, it should not be construed as being in any way limited to the presented examples. The scope of the present invention is to be interpreted in the light of the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A method for preparing a polymer article with an original surface for subsequent selective metallization, comprising:

submerging the article in a first liquid;

in the liquid, irradiate the submerged article by electromagnetic radiation by irradiating the area of the article on which the metal is to be deposited, thereby forming a selected area, wherein the source of the radiation is a laser source, and an activation step, prior to the selective metallization, the activation step comprises submerging the article in an activation liquid for depositing seed particles in the selected area, wherein the irradiation of the selected area is selected and controlled so as to cause a temporary melting of the polymer in the surface of the selected area of the polymer article, resulting in an increase in porosity of the selected area as measured by the ratio (fpor) between void volume to total volume;

wherein the temporary melting forms a temporarily melted region;

and wherein the temporarily melted region has a height extending above the original surface.

2. The method according to claim 1, wherein the increase in porosity is at least 5%.

3. The method according to claim 1, wherein the temporarily melted region in the surface of the selected area has a depth (D) to width (W) ratio of at least 5% in at least in some regions of the selected area.

4. The method according to claim 1, wherein the temporarily melted polymer in the selected area forms a continuous area.

5. The method according to claim 1, wherein an averaged delivered irradiation energy to the selected area is selected dependent on the effective melting point of the polymer article.

6. The method according to claim 1, wherein an averaged delivered irradiation energy is selected so as to avoid burning or decomposition of the polymer article.

7. The method according to claim 1, wherein an averaged delivered irradiation energy to the selected area is maximum 20 J/mm$^2$.

8. The method according to claim 1, further comprising a step of selective metallization of the selected areas activated in the activation step.

9. The method according to claim 8, wherein the seed particles are palladium particles or palladium complexes.

10. The method according to claim 8, wherein the activation liquid comprises a solution of palladium salt and tin salt.

11. The method according to claim 8, wherein the article is rinsed subsequent to the activation step.

12. The method according to claim 8, wherein the selective metallization step comprises a deposition step subsequent to the activation step, wherein the deposition step comprises submerging the article in a deposition liquid, thereby selectively metallizing the selected area.

13. The method according to claim 12, wherein the deposition liquid is a copper deposition liquid.

14. The method according to claim 1, wherein the first liquid is an acid selected from the group consisting of inorganic acids, and solutions or mixtures thereof, organic acids, and solutions or mixtures thereof.

15. The method according to claim 14, wherein the acid is selected from the group consisting of phosphoric acid, sulfuric acid, hydrochloric acid, methanesulfonic acid, citric acid, succinic acid, adipic acid, amidosulfuric acid, malonic acid, methanoic acid, ethanoic acid, propanoic acid, n-butanoic acid, n-pentanoic acid, n-hexanoic acid, oxalic acid, sodium hydrogen sulfate, potassium hydrogen sulfate, borofluoric acid, and solutions or mixtures thereof.

16. The method according to claim 1, wherein the first liquid is an organic solvent.

17. The method according to claim 16, wherein the organic solvent is selected from the group consisting of ethanol, isopropanol, ethylene glycol, N-methyl-pyrrolidone, and mixtures thereof.

18. The method according to claim 1, wherein at least part of the selected area is defined by moving the laser source.

19. The method according to claim 1, wherein prior to irradiating the article, the article is covered by a mask, the mask defining at least part of the selected area.

20. The method according to claim 1, wherein the polymer is a thermoplastic material.

21. The method according to claim 1, wherein the polymer is selected from the group consisting of Acrylonitrile Butadiene Styrene (ABS), PolyButylene Terephthalate (PBT), Liquid Crystal Polymer (LCP), CycloOlefin Copolymer (COC), PolyMethyl MethAcrylate (PMMA), PolyPropylene (PP), PolyEthylene (PE), PolyTetraFluoroEthylene (PTFE), PolyPhenylene Ether (PPE), PolyStyrene (PS), PolyCarbonate (PC), PolyEtherImide (PEI), PolyEtherEtherKetones (PEEK), Polyethylene Terephtalate (PET), PolyAmide (PA) and blends thereof.

22. The method according to claim 1, wherein the article is rinsed prior to submerging the article in the first liquid.

23. The method according to claim 22, wherein the article is further dried prior to submerging the article in the first liquid.

24. The method according to claim 1, wherein the first liquid is selected from the group consisting of inorganic bases, organic bases, and solutions or mixtures thereof.

25. The method according to claim 24, wherein the base is selected from the group consisting of sodium hydroxide, potassium hydroxide, and solutions or mixtures thereof.

* * * * *